US006458028B2

(12) United States Patent
Snyder

(10) Patent No.: US 6,458,028 B2
(45) Date of Patent: Oct. 1, 2002

(54) DIFFUSER AND CEILING FAN COMBINATION

(76) Inventor: Darryl L. Snyder, 4520 N. Market Ave., Canton, OH (US) 44714

( * ) Notice: Subject to any disclaimer, the term of this patent is extended or adjusted under 35 U.S.C. 154(b) by 0 days.

(21) Appl. No.: 09/736,995

(22) Filed: Dec. 14, 2000

Related U.S. Application Data

(60) Provisional application No. 60/172,265, filed on Dec. 17, 1999, and provisional application No. 60/226,163, filed on Aug. 18, 2000.

(51) Int. Cl.[7] ..... F24F 13/062
(52) U.S. Cl. ..... 454/292; 454/300
(58) Field of Search ..... 454/292, 293, 454/294, 297, 300

(56) References Cited

U.S. PATENT DOCUMENTS 4,494,449 A * 1/1985 McCabe ..... 454/292
4,729,725 A * 3/1988 Markwardt ..... 416/244 R
5,411,438 A * 5/1995 White et al. ..... 137/601.08
5,564,980 A * 10/1996 Becker ..... 454/252
5,795,220 A * 8/1998 Core ..... 454/292
5,873,556 A * 2/1999 Reiker ..... 248/323
6,030,287 A * 2/2000 Core ..... 454/292

* cited by examiner

*Primary Examiner*—Harold Joyce
(74) *Attorney, Agent, or Firm*—Sand & Sebolt

(57) ABSTRACT

A diffuser for a ceiling allows a ceiling fan to be mounted directly below the diffuser so that the fan may distribute the air being delivered out of the diffuser. The diffuser includes an upper box section mounted on a lower section that mounts the diffuser on the ceiling. The down rod of the ceiling fan is connected to the diffuser to support the ceiling fan. The down rod may be supported above the upper section so that the electrical connections between the ceiling fan and an electrical source may be positioned outside of the diffuser.

15 Claims, 6 Drawing Sheets

DIFFUSER AND CEILING FAN COMBINATION

CROSS REFERENCE TO RELATED APPLICATIONS

This application claims priority from U.S. Provisional Application Ser. No. 60/172,265 filed Dec. 17, 1999, and from U.S. Provisional Application Ser. No. 60/226,163 filed Aug. 18, 2000; the disclosures of which are incorporated herein by reference.

BACKGROUND OF THE INVENTION

1. Technical Field

The present invention generally relates to heating, ventilation, and air conditioning air distribution equipment and, more particularly, to a ceiling diffuser that includes a ceiling fan to more thoroughly distribute the air flowing through the diffuser.

2. Background Information

Heating, ventilation, and air conditioning duct work in commercial buildings is typically disposed above the ceiling. Air is distributed into the rooms of the building through vents located in the ceiling. Diffusers are used in the vents to evenly distribute the air flowing out of the vent.

Ceiling fans are also used to distribute air. Ceiling fans hang below the ceiling of a room. One problem in the prior art is that ceiling fans must be hung away from the vents because the ceiling fans must be connected to a support structure. The removed position of the ceiling fan often creates cold or warm spots in the room. The art thus desires a structure that allows a typical ceiling fan to be mounted directly below a diffuser in a ceiling vent. Another problem in the art is that rooms have limited panels in which to install lights, vents, fans, sprinklers, speakers, etc. The art desires devices that combine these elements to limit the number of ceiling panels used in a room.

SUMMARY OF THE INVENTION

The present invention provides a diffuser for a heating, ventilation, and air conditioning system that allows a ceiling fan to be centered directly below the diffuser. The invention provides this combination by providing a diffuser box having a mount that receives a standard ceiling fan. The invention provides the combination diffuser and ceiling fan while allowing the electrical connection between the ceiling fan and electrical service to occur outside of the diffuser box.

The invention provides the above combination in further combination with a light to minimize the number of ceiling panels filled in a given room.

BRIEF DESCRIPTION OF THE DRAWINGS

Similar numbers refer to similar parts throughout the specification.

DESCRIPTION OF THE PREFERRED EMBODIMENTS

Figure 3:
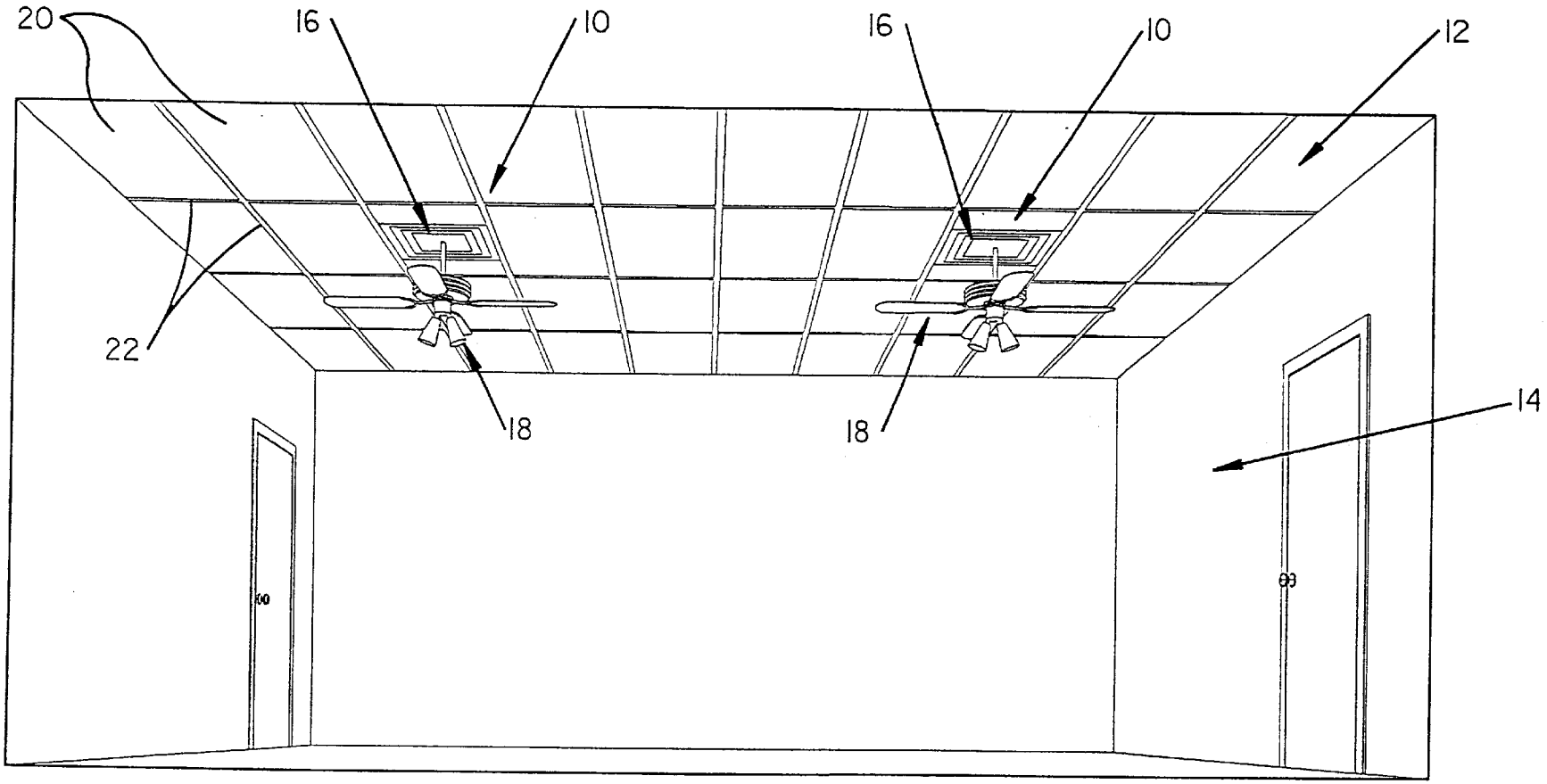
FIG. 3 is a perspective view of a room using two combined diffuser and ceiling fans of the present invention.

The first embodiment of the combined diffuser and ceiling fan combination of the present invention is indicated generally by the numeral 10 in the accompanying drawings. Combination 10 is depicted in FIG. 3 as being installed in a typical drop ceiling 12 in a room 14. Combination 10 functions to evenly distribute air within room 14 by immediately distributing air exiting the diffuser 16 with the fan 18.

Figure 1:
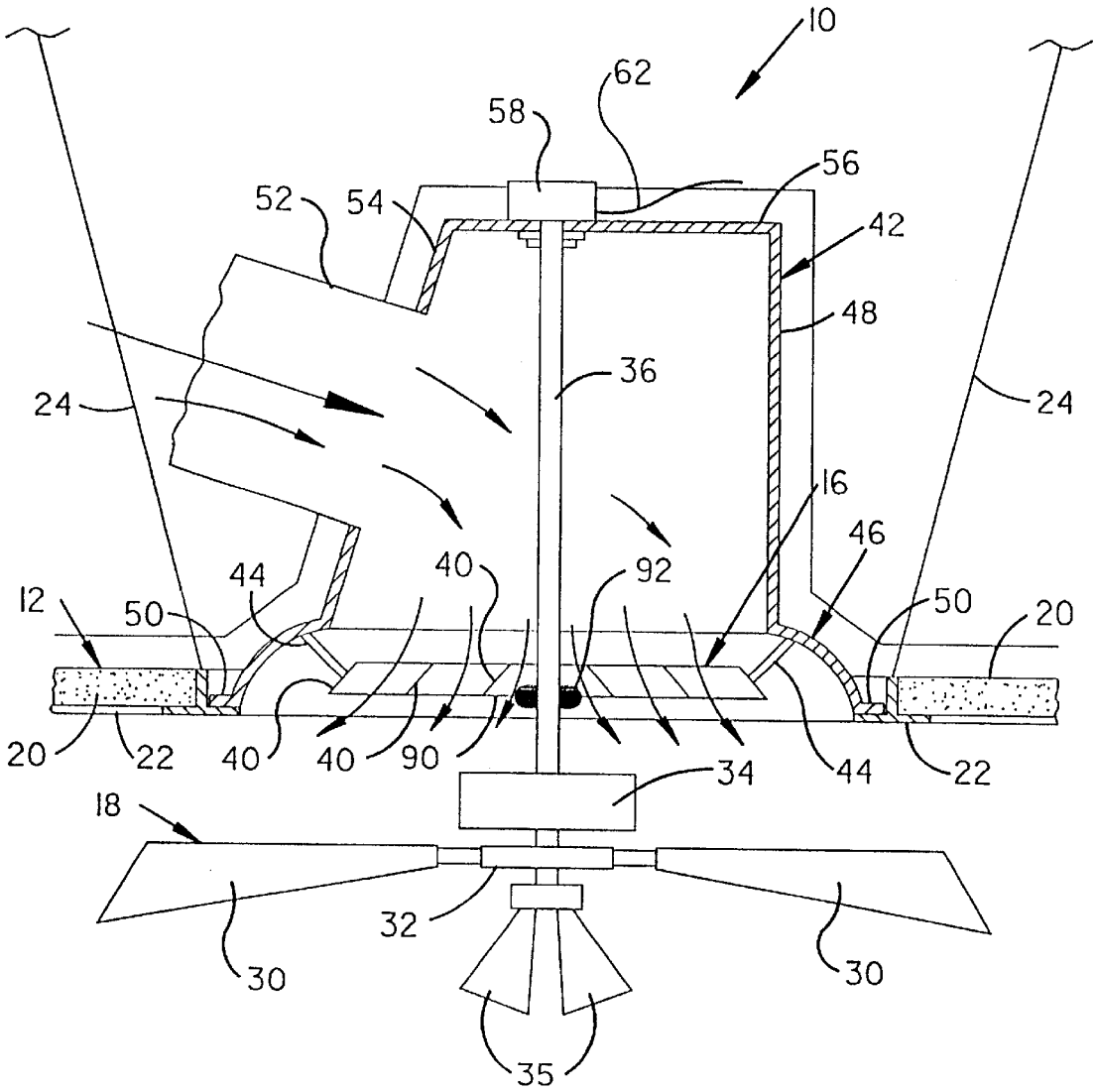
FIG. 1 is a front view, partially in section, of the first embodiment of the combination diffuser and ceiling fan of the present invention.

As shown in FIGS. 1 and 3, ceiling 12 includes a plurality of ceiling panels 20 supported by a plurality of frame members 22. Various types of ceiling panels 20 and frame members 22 are known in the art and combination 10 of the present invention is intended to work with a wide variety of ceiling panels 20 and frame members 22. Frame members 22 are typically supported by supports 24 from a fixed roof (not shown) of the building. In addition, combination 10 is intended to work with other ceilings 12 other than the drop ceiling disclosed in the drawings. Combination 10 decreases the number of ceiling panels used to support items in a room.

Ceiling fan 18 is any of a variety of ceiling fans known in the art that includes a plurality of blades 30 extending from a hub 32 that is rotatingly driven by a motor 34. Fan 18 may also include one or more lights 35. Motor 34 is supported by a down rod 36. Down rods 36 known in the art are typically ½ inch or ¾ inch outside diameter and include a hollow channel 38 that receives wire 39 that provides power to motor 34. Fan 18 may be rotated in either direction and the speed of rotation is typically controlled by the user.

Diffuser 16 includes a plurality of concentrically-disposed vanes 40. Vanes 40 may be square as depicted in FIG. 3, triangular, round (FIG. 6), or any of a variety of other shapes as is known in the art. Vanes 40 are connected together and supported from a diffuser box 42 by supports 44. Diffuser box 42 includes a lower section 46 and an upper section 48. Lower section 46 of diffuser box 42 is configured to be supported by support members 22 and is typically the same size as one ceiling panel 20 so that lower diffuser section 46 replaces a ceiling panel 20 as shown in FIG. 3. Box 42 thus rests on four supports 22. Section 46 may include feet 50 that rest on support members 22 and may be connected to support members 22 by connectors such as screws, bolts, rivets, adhesive, etc. In past diffusers, the air inlet tube 52 connected directly to section 46 so that the air flowing through tube 52 was directed immediately into vanes 40 and into room 12. In the present invention, air inlet tube 52 is connected to upper section 48 of box 42. In the preferred embodiment, air inlet tube 52 is connected to a side wall 54 of upper section 48.

Figure 4:
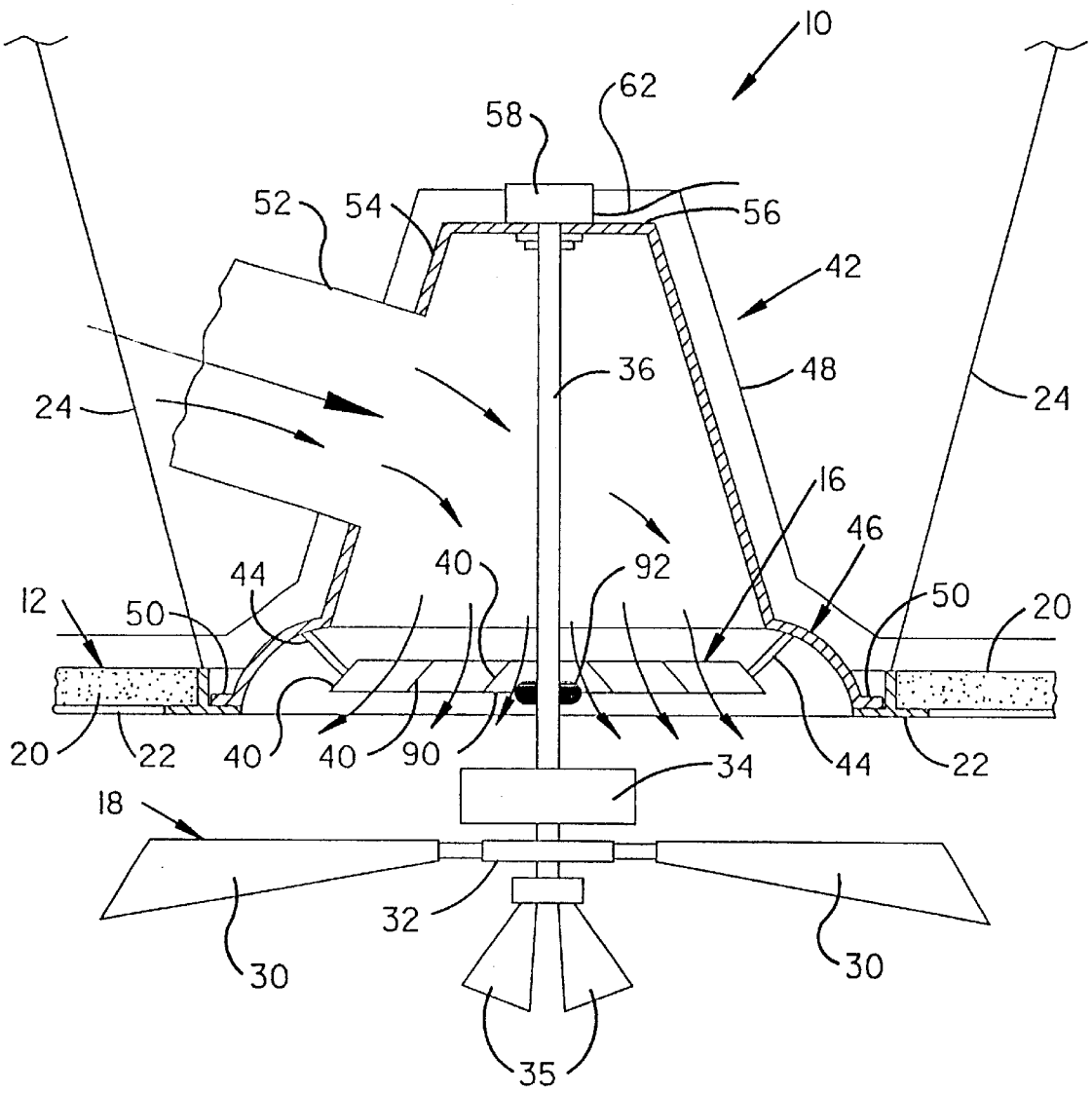
FIG. 4 is a view similar to FIG. 1 showing an alternative upper section.

Side wall 54 is angled with respect to vertical so that the air flowing into box 42 is directed downwardly toward vanes 40. In an alternative embodiment, the opposite wall is angled (FIG. 4) to strengthen upper wall 56 and to direct air downwardly.

Diffuser box 42 includes an upper wall 56. Upper wall 56 supports an electrical box 58 that contains the electrical connection 60 between wire 39 and electrical supply wire 62. Electrical box 58 also supports down rod 36 in a position where rod 36 is centered with respect to vanes 40.

Down rod 36 is supported by electrical box 58 with a collar 70 that includes an upper section 72 and a threaded lower section 74. Threaded lower section 74 threadedly receives a nut 76 that clamps against a support plate 78. Support plate 78 engages wall 56. Collar 70 has a shoulder 80 that rests inside electrical box 58. Upper section 72 includes a hole that receives a pin 82 that 20 extends through collar 70 and through down rod 36 to prevent down rod 36 from rotating with respect to electrical box 58 and moving downwardly or upwardly with respect to electrical box 58. Collar 70 is preferably connected to electrical box 58 by a secondary connector 84 to prevent collar 70 from rotating with respect to electrical box 58. Connector 84 may be any of a variety of connectors suitable for holding collar 70 stationary with respect to electrical box 58. For instance, connector 84 may be a pin, a screw, a bolt, an adhesive, a nut and bolt combination, a protuberance that interferes with the rotation of collar 70, etc.

Down rod 36 extends through the center of vanes 40 and is connected to the bottom wall 90 of vanes 40 by a grommet 92. Grommet 92 prevents down rod from rattling with respect to vanes 40 and dampens vibration.

Figures 2, 2A:
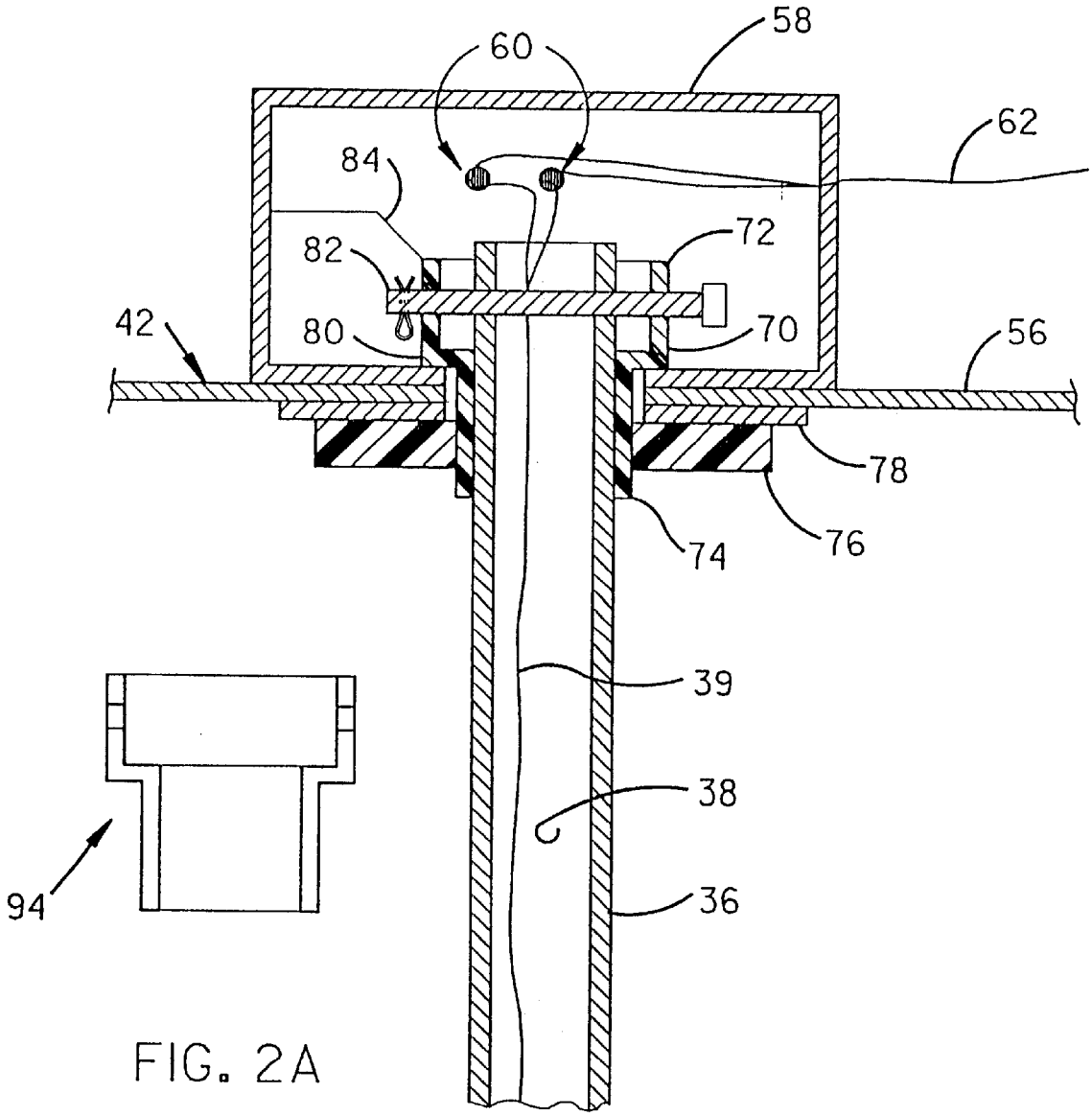
FIG. 2 is a sectional front view of the connection between the ceiling fan and the top of the diffuser box.
FIG. 2A is a sectional view of a collar insert for use with a smaller diameter down rod.

When down rod 36 is reduced in diameter, grommet 92 is increased in size to make up the difference. In addition, a collar insert 94 (FIG. 2A) is fitted within collar 70 to accept the smaller diameter down rod 36.

Figure 5:
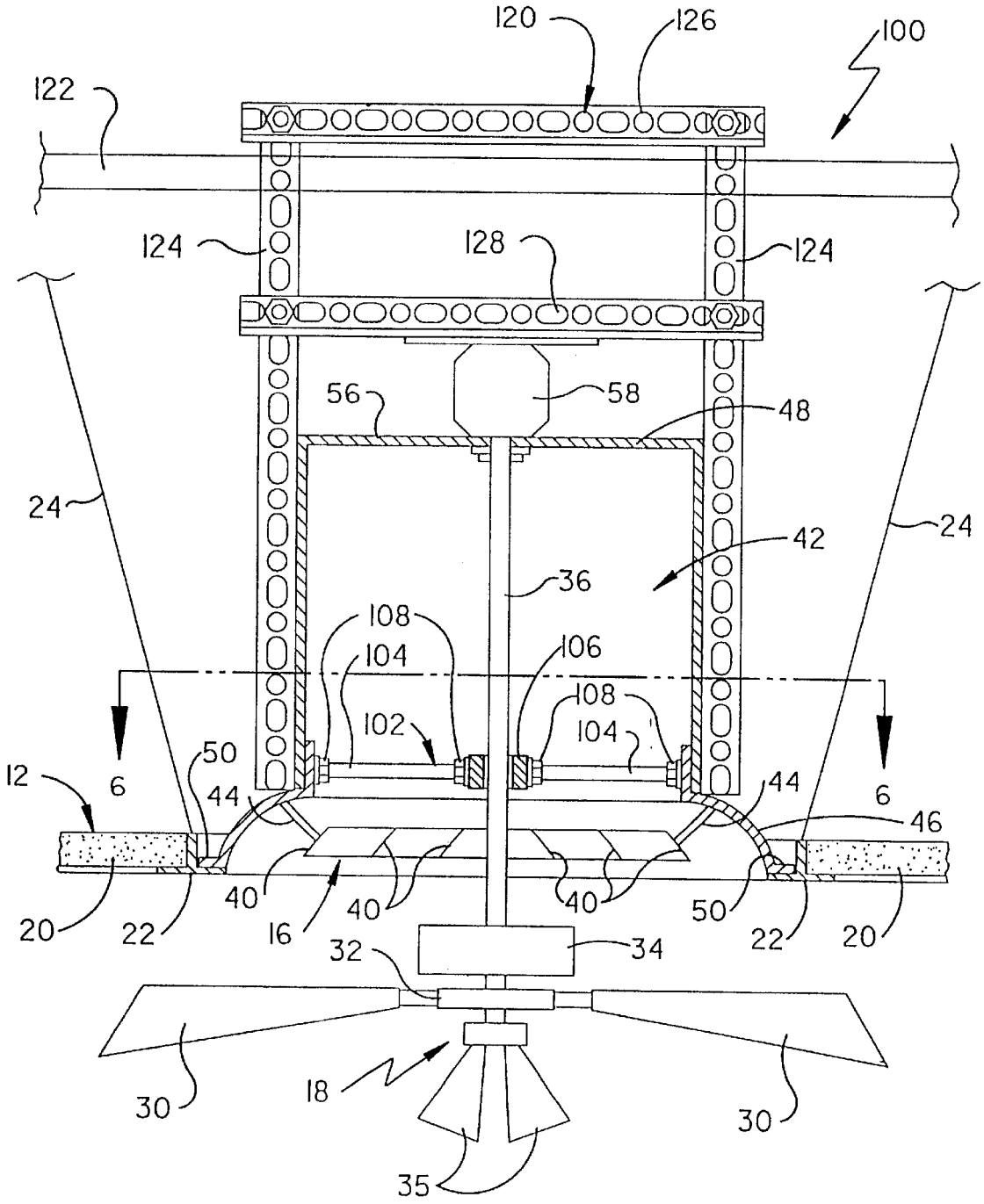
FIG. 5 is a side sectional view of a second embodiment of the combination diffuser and ceiling fan.
Figure 6:
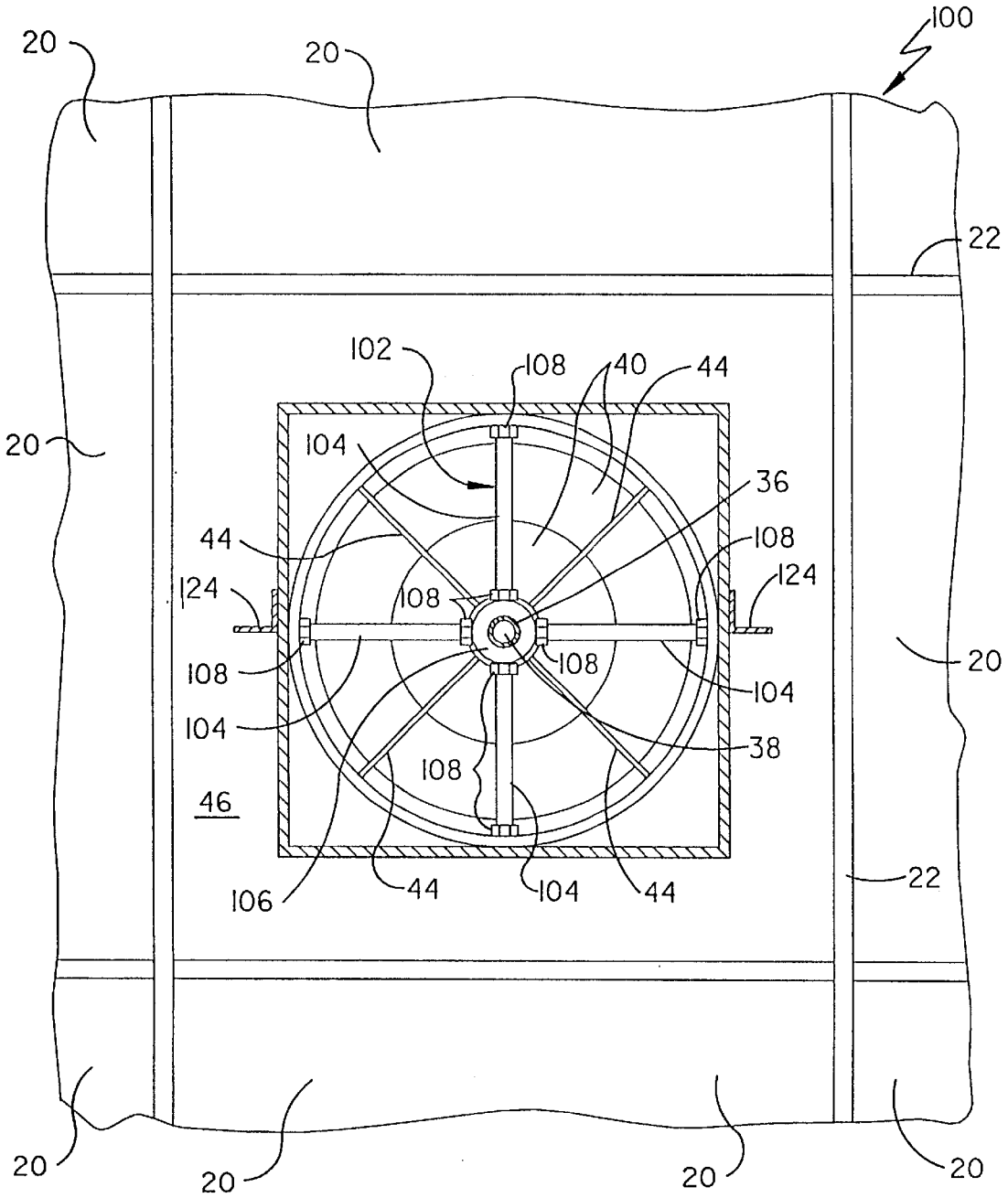
FIG. 6 is a sectional view taken along line 6–6 of FIG. 5.

The second embodiment of the combined diffuser and ceiling fan combination of the present invention is indicated generally by the numeral 100 in FIGS. 5 and 6. Combination 100 is depicted in FIG. 5 as being installed in a typical drop ceiling 12 in a room similar to room 14 depicted in FIG. 3. Combination 100 functions to evenly distribute air within the room by immediately distributing air exiting the diffuser 16 with fan 18.

Combination 100 includes many of the same elements described above described above with respect to combination 10 and the same numbers are used to refer to these elements. Combination 100 includes a support assembly 102 that supports down rod 36 from diffuser box 42. In the embodiment of the invention depicted in the drawings, support assembly 102 is connected to lower section 46 of diffuser box 42.

Support assembly 102 includes a plurality of support rods 104 that extend from box 42 to a collar 106 that surrounds down rod 36. Collar 106 prevents down rod 36 from shaking or rattling if fan 18 becomes unbalanced. Each support rod 102 is adjustable through the use of adjustment nuts 108 disposed on both inner and outer ends of support rods 104. Support assembly 102 allows combination 100 to be used without grommet 92.

Combination 100 also includes a support frame 120 that supports diffuser box 42 from the structural elements 122 of the building in which combination 100 is being installed. Support frame 120 includes at least two vertical risers 124 that are connected to the sides of box 42. An upper horizontal support 126 extends across the top ends of vertical risers 124. An intermediate horizontal support 128 extends between vertical risers 124 and is positioned above electrical box 58. Intermediate horizontal support 128 supports the top of electrical box 58 and thus provides support to fan 18 that is connected to support structure 122.

The outside of box 42 is preferably insulated with an insulating material that prevents box 42 from gathering condensation. Down rod 36 is also preferably covered with a foam insulation to prevent down rod 36 from gathering condensation.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

What is claimed is:

1. In combination, a ceiling fan and a diffuser adapted to be positioned at a vent in a ceiling wherein an air inlet tube delivers air to the vent;

the ceiling fan including a down rod, a motor, and a plurality of fan blades;

the down rod of the ceiling fan passing through a portion of the diffuser to position the fan blades of the ceiling fan below the diffuser;

the diffuser including a diffuser box having an upper wall; the combination including an electrical box supported above the upper wall of the diffuser box; and the down rod of the ceiling fan being supported by the electrical box; and further including a collar disposed inside the electrical box;

the collar being connected to the electrical box with a first connector;

the collar surrounding a portion of the down rod; and the down rod being connected to the collar.

2. The combination of claim 1, wherein the diffuser includes an upper section having at least two opposed sidewalls.

3. The combination of claim 1, wherein the down rod is centered with respect to the diffuser.

4. The combination of claim 1, wherein the down rod is connected to the collar with a pin extending through the collar and the down rod.

5. The combination of claim 4, further comprising a secondary connector connecting the collar to electrical box.

6. The combination of claim 1, further comprising a grommet disposed between the down rod and the diffuser.

7. The combination of claim 1, further comprising a support assembly connected to the diffuser; the support assembly engaging the down rod of the ceiling fan to support the down rod.

8. The combination of claim 1, further comprising a support frame connected to the diffuser.

9. The combination of claim 8, wherein the support frame includes:

at least two vertical risers that are connected to the diffuser;

an upper horizontal support that extends across the vertical risers; and an intermediate horizontal support that extends between the vertical risers; the intermediate horizontal support being positioned between the upper horizontal support and the diffuser.

10. The combination of claim 9, wherein the electrical box is connected to the intermediate horizontal support.

11. The combination of claim 1, wherein the diffuser is covered with an insulating material.

12. The combination of claim 11, wherein the down rod is covered with an insulating material to prevent down rod from gathering condensation.

13. In combination, a ceiling fan and a diffuser adapted to be positioned at a vent in a ceiling wherein an air inlet tube delivers air to the vent;

the ceiling fan including a down rod, a motor, and a plurality of fan blades;

the down rod of the ceiling fan passing through a portion of the diffuser to position the fan blades of the ceiling fan below the diffuser;

a support assembly connected to the diffuser; the support assembly engaging the down rod of the ceiling fan to support the down rod;

the support assembly including a collar that surrounds a portion of the down rod; and a plurality of support rods that extend from the diffuser to the collar; the support assembly preventing the down rod from shaking or rattling when the ceiling fan becomes unbalanced.

14. In combination, a ceiling fan and a diffuser adapted to be positioned at a vent in a ceiling wherein an air inlet tube delivers air to the vent;

the ceiling fan including a down rod, a motor, and a plurality of fan blades;

the down rod of the ceiling fan passing through a portion of the diffuser to position the fan blades and the motor of the ceiling fan below the diffuser;

a support assembly connected to the diffuser; the support assembly engaging the down rod of the ceiling fan to support the down rod;

the support assembly including a collar that surrounds a portion of the down rod; and a plurality of support rods that extend from the diffuser to the collar; the support assembly preventing the down rod from shaking or rattling when the fan becomes unbalanced.

15. The combination of claim 14, further comprising an electrical box that supports the down rod.

* * * * *